United States Patent [19]

Sone et al.

[11] 4,337,408

[45] Jun. 29, 1982

[54] PLASMA JET IGNITION PLUG

[75] Inventors: Masazumi Sone; Yukitsugu Hirota, both of Yokohama, Japan

[73] Assignee: Nissan Motor Co., Ltd., Tokyo, Japan

[21] Appl. No.: 141,695

[22] Filed: Apr. 18, 1980

[30] Foreign Application Priority Data

Apr. 23, 1979 [JP] Japan ..... 54-55010[U]

[51] Int. Cl.[3] ..... H01T 13/54

[52] U.S. Cl. ..... 313/130; 313/131 A; 313/143

[58] Field of Search ..... 313/130, 131 R, 131 A, 313/134 , 143; 123/169 EL, 169 G; 315/46, 85

[56] References Cited

U.S. PATENT DOCUMENTS

| | | | |
|---|---|---|---|
| 2,840,742 | 6/1958 | Watters | 313/131 R |
| 2,939,983 | 6/1960 | Pierce et al. | 313/131 R |
| 3,442,693 | 5/1969 | Rea | 313/131 R X |
| 3,911,307 | 10/1975 | Goto et al. | 313/143 |

FOREIGN PATENT DOCUMENTS

| | | | |
|---|---|---|---|
| 2436896 | 3/1975 | Fed. Rep. of Germany | 313/143 |

*Primary Examiner*—Eugene R. La Roche

*Attorney, Agent, or Firm*—Lane, Aitken, Kice & Kananen

[57] ABSTRACT

A plasma jet ignition plug wherein a film of semiconductor or a semiconductor oxide defines together with a first rod-shaped electrode and a second electrode a plasma cavity.

5 Claims, 5 Drawing Figures

PLASMA JET IGNITION PLUG

BACKGROUND OF THE INVENTION

The present invention relates to a plasma jet ignition plug, and more particularly to a plasma jet ignition plug for a plasma jet ignition system for an automotive internal combustion engine.

In order to extend the lean misfire limit of the conventional spark ignition internal combustion engines, there is a continuing interest in new ignition sources and their effects on engine performance and emissions. Various kinds of new ignition systems have been proposed.

A plasma jet ignition plug 10, as shown in FIG. 1, has been proposed which comprises a first or rod-shaped electrode 1, a second electrode 2, and an insulating body 3 of a ceramic, for example, which together with the first and second electrodes defines a substantially enclosed plasma cavity 4. The second electrode closes one end of the plasma cavity and is formed with an orifice 5 therethrough. The first rod-shaped electrode 1 extends part-way towards the second electrode 2 whereby to define a plasma cavity gap between said first and second electrodes.

Different from the usual spark plug that directly heats the air fuel mixture up to its ignition temperature, the plasma jet ignition plug 10 generates a spark across the plasma cavity gap, thus generating a high temperature, high energy plasma gas within the plasma cavity 4. This gaseous plasma confined in the plasma cavity 4 is partially ejected though the orifice 5 owing to an increase in pressure of the confined plasma within the plasma cavity 4. The ejected gaseous flow of plasma, with high temperature and high energy, forms many small spot-like flames within the combustion chamber of the engine, thus assuring safe ignition of the air fuel mixture.

Connected to the first electrode 1 of the plasma jet ignition plug 10 is a power source 20 which includes a spark energy storage system **20*a* and a plasma jet energy storage system 20*b***.

The spark energy storage system **20*a* is substantially similar in construction to a conventional ignition system and provides the basic spark timing and high voltage trigger signal to the plasma jet ignition plug 10. It includes a cam 21 which is rotatable in timed relationship with the engine rotation, a breaker 22*a* with a breaker arm 22, an ignition coil 23 having a primary winding 23*a* connected to the breaker 22*a* and a secondary winding 23*b*, and a battery 24**.

The plasma jet energy storage system **20*b* includes a coil 25, a storage capacitor 26 connected in series with the coil 25, a charging resistor 27, and a power source 28. A steering diode 29 is arranged to prevent the spark energy from flowing into the storage capacitor 26**.

In operation, the contact **22*a* is moved to an open position by the contact arm 22 activated by the cam 21 which rotates in timed relationship with the engine rotation, a primary current passing through the primary winding 23*a* is interrupted, thus inducing a high voltage on the secondary winding 23*b*, causing the discharge of a spark to take place within the plasma cavity 4 between the first electrode 1 and the second electrode 2. This spark discharge causes a breakdown of insulation of the plasma cavity 4 so that a discharge of spark within the discharge cavity 4 becomes possible even with a relatively low voltage. Thus the discharge of spark will continue within the discharge cavity owing to the supply of direct current from the plasma energy storage system 20*b*. That is, all of the energy stored on the capacitor 26, having been charged by the power source 28 via the resistor 27, is discharged via the steering diode 29 and coil 25, thus sustaining the discharge of spark within the plasma cavity 4**.

The discharge of a spark by the plasma jet ignition plug generates an electromagnetic wave noise that disturbs radio broadcasting service, television broadcasting service and other kinds of radio communication systems. The noise also causes operational errors in electronic control circuits, for example electronic controlled fuel injection systems and electronic controlled skid control systems. As a result, traffic safety will be threatened.

In order to suppress the noise, there has been proposed to use a resistance plasma jet ignition plug which has an electrode containing a resistance of the order ranging from several KΩ to 10 KΩ. This proposal is defective in that an increase in resistivity causes a reduction in plasma jet energy to an unacceptable low level, deteriorating the ignition capability.

SUMMARY OF THE INVENTION

An object of the present invention is to provide a plasma jet ignition plug with an arrangement for reducing a noise due to spark discharge.

The invention concerns a plasma jet ignition plug which comprises a first electrode, a second electrode, an insulating body which has surfaces that define together with the first and second electrodes a substantially enclosed plasma cavity; the second electrode closing one end of the plasma cavity and being formed with an orifice therethrough, the first electrode extending part-way towards the second electrode whereby to define a plasma cavity gap between the first and second electrodes, wherein the insulating body formed on said surfaces with a film made of one of a semiconductor and a semiconductor oxide.

The invention will be hereinafter described in connection with the accompanying drawings:

DETAILED DESCRIPTION OF THE INVENTION

Figure 1:
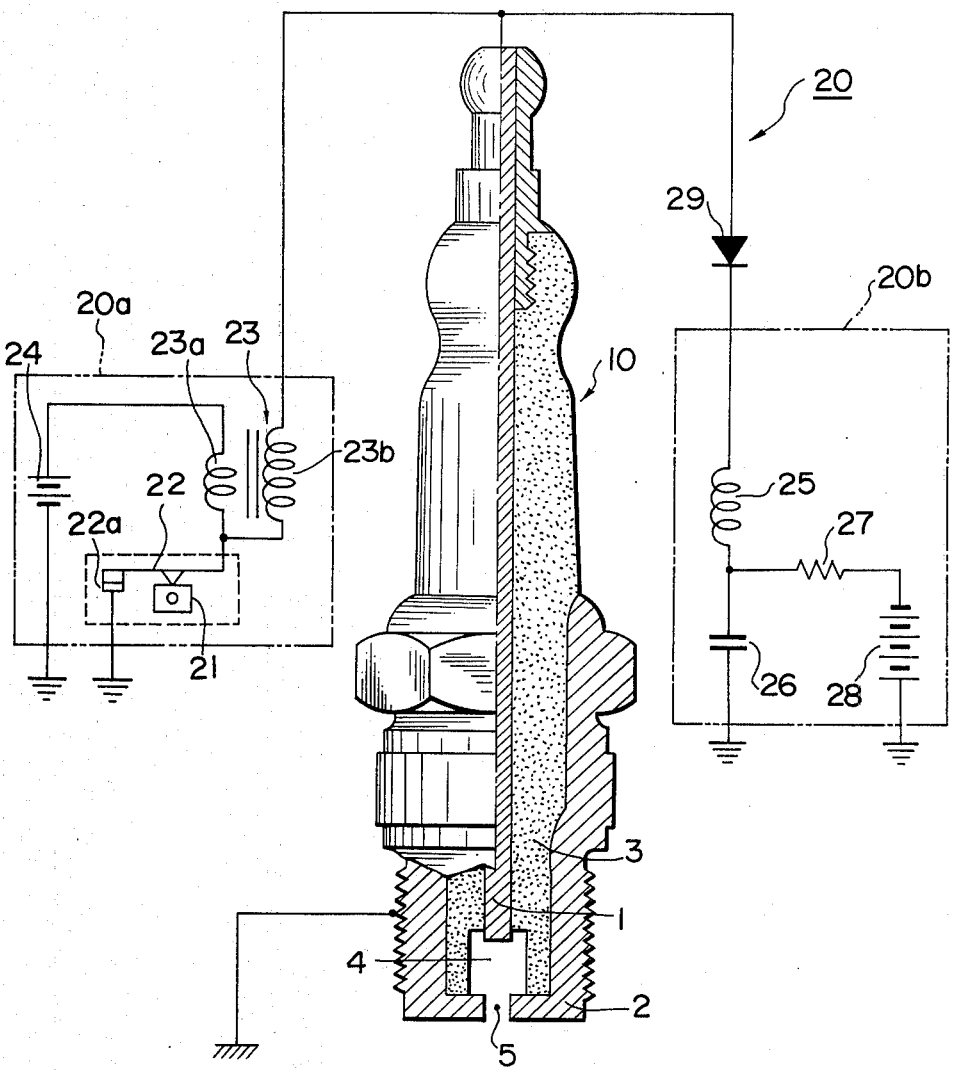
FIG. 1 PRIOR ART
FIG. 1 is a side view, partly in section, of a prior art plasma jet ignition plug associated with a power source including a spark energy storage system and a plasma energy storage system.
Figure 2:
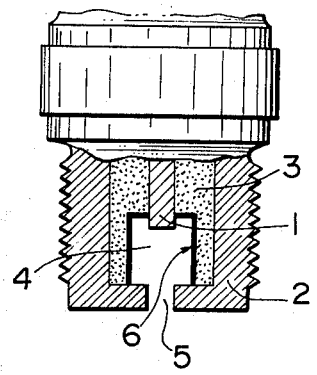
FIG. 2 is a partial view of FIG. 1 showing a first embodiment of a plasma jet ignition plug according to the present invention.

Referring to FIG. 2, like reference numerals as used in FIG. 1 are used to designate like parts, wherein the reference numeral 1 designates a first or rod-shaped electrode 1; numeral 2 designates a second electrode; number 3 refers to an insulating body which together with the first and second electrodes 1, 2 defines a substantially enclosed plasma cavity 4. The second electrode 2 closes one end of the plasma cavity 4 and is formed with an orifice 5 therethrough. The first or rod-shaped electrode 1 extends part-way toward the second electrode 2 whereby to define a plasma cavity gap between the first and second electrodes 1, 2.

Figure 3:
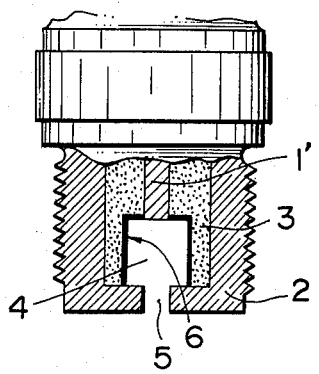
FIG. 3 is a similar view to FIG. 2 showing a second embodiment of a plasma jet ignition plug.

The insulating body 3 has surfaces formed thereon with a film 6 made of a semiconductor or semiconductor oxide. The film 6 formed on the insulating body 3 defines together with the first and second electrodes 1, 2 the plasma cavity 4. In this embodiment, the film is a silicon. This silicon film 6 is formed by ion plating or sputtering or plasma spraying and has a thickness of at least 2 $\mu$m to 3 $\mu$m. This film may be formed of a silicon compound, such as $SiO_2$ or SiC. It may take the construction as shown in FIG. 3 wherein the surface of the film 6 is in flush with the end of the first or rod-shaped electrode 1'.

The construction thus far described makes it possible that silicon combines with oxygen to make $SiO_2$ as a result of spark discharge, allowing an accumulation of ions on the silicon film 6 to strengthen an electric field across the electrodes 1, 2. An increase in the strength of the electric field causes a promotion of electron emission and ionization between the electrodes 1, 2. Speaking to plasma discharge, the discharge takes place in the form of creeping discharge along the surface of the silicon film 6 so that an increase in the electron emission and ionization results in promotion in creeping discharge, thus making it possible to reduce spark discharge current and spark discharge voltage.

It is thought that usually noise electric field is proportional to noise current. Since the noise current can be reduced in response to a reduction in spark discharge current, thus it is possible to reduce noise field by reducing discharge current and discharge voltage.

Figure 4:
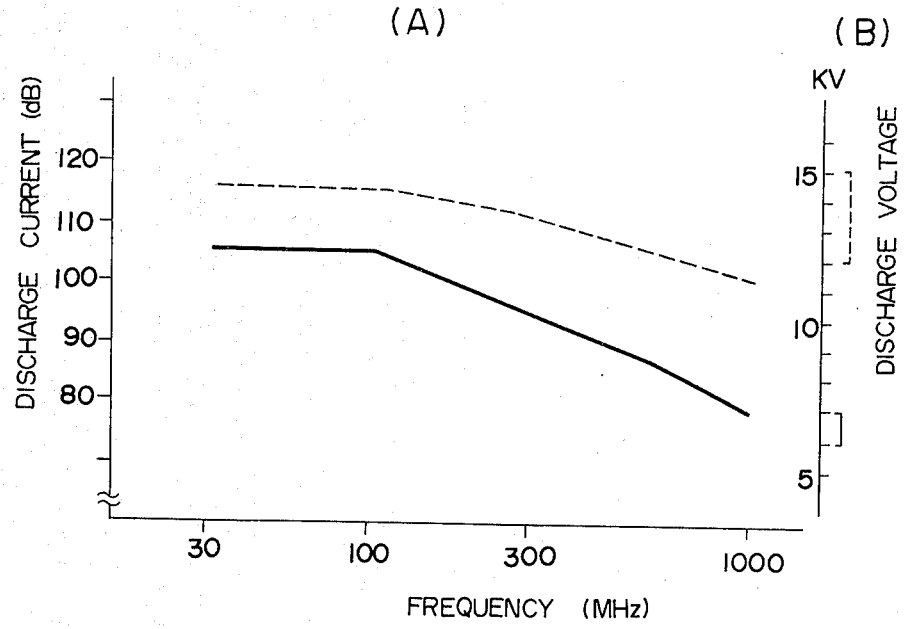
FIG. 4 is a graph of discharge current versus frequency.

An experiment, conducted by the inventor, for comparison of the plasma jet ignition plug constructed as described in the preceding and the prior art plasma jet ignition plug, revealed that there occured an appreciable drop in discharge current (noise current) and discharge voltage as shown in FIGS. 4(A) and 4(B). In these Figures, the dotted line shows the characteristics of the conventional ignition plug, while the solid line the ignition plug according to the invention.

Figure 5:
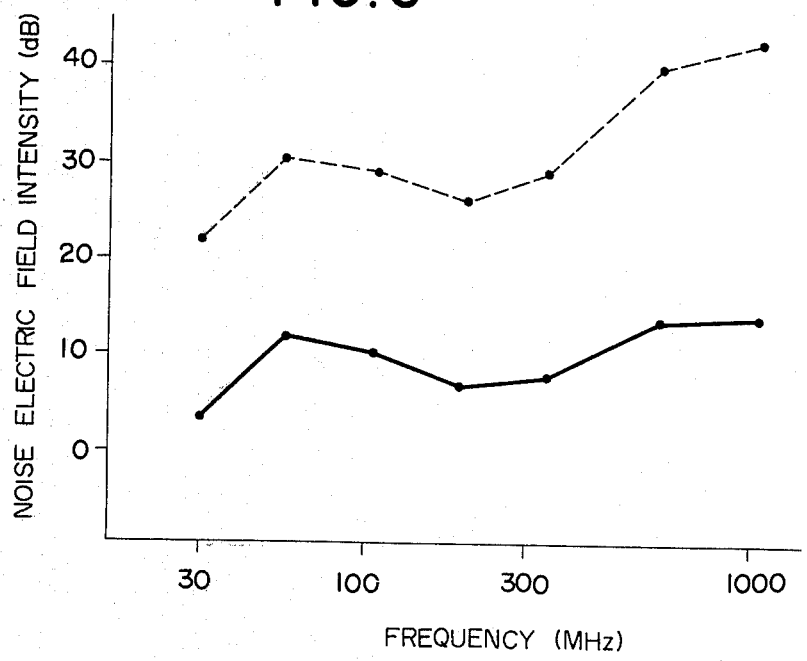
FIG. 5 is a graph of noise electric field intensity versus frequency.

FIG. 5 is a graph illustrative of how effectively noise field density has been reduced, wherein actual measured values obtained from an experiment with four cylinder internal combustion engine with displacement volume of 1,800 cc are plotted as 1 $\mu V = 0$ dB. In this Figure, the dotted line shows the conventional and the solid line the invention. As will be understood from this with the use of the spark plug of the invention noise suppressing effect of more than 20 dB has been obtained.

It will now be understood that the construction of a plasma jet ignition plug of the invention wherein the inner wall defining a plasma cavity gap formed between a first or rod-shaped electrode and a second electrode is covered with a semiconductor film or semiconductor oxide film, provides a reduction in discharge current and discharge voltage, thus effectively preventing the operational errors of the other electric circuits installed on an automobile by reducing noise current. Besides, ignition capability enhances due to a reduction in discharge voltage, thus greatly reducing the probability of misfire and thus preventing the electrodes from becoming dirty due to misfire. The reduction in discharge voltage causes a reduction in the total energy required for plasma jet ignition, thus making it possible to miniaturize the power source and to enhance the safety against an electric shock.

What is claimed is:

1. A plasma jet ignition plug comprising:

a first electrode;

an insulating body surrounding and supporting said first electrode and forming a plasma cavity surrounding one end of said first electrode;

a second electrode positioned in engagement with a portion of said insulating body and having a portion closing said plasma cavity, said portion having an orifice therethrough and opening into said plasma cavity; and a film on said insulating body defining said plasma cavity, said film being made of a semiconductor including a silicon compound.

2. A plasma jet ignition plug as claimed in claim 1, wherein said silicon compound is one of $SiO_2$ and SiC.

3. A plasma jet ignition plug as claimed in claim 1 or 2, wherein said one end of said first electrode projects into said plasma cavity.

4. A plasma jet ignition plug as claimed in claim 1 or 2, wherein said one end of said first electrode is substantially flush with the adjacent surface of said film.

5. A plasma jet ignition plug comprising:

a first electrode;

an insulating body surrounding and supporting said first electrode and forming a plasma cavity surrounding one end of said first electrode;

a second electrode positioned in engagement with a portion of said insulating body and having a portion closing said plasma cavity, said portion having an orifice formed therethrough and opening to said plasma cavity;

a film on said insulating body defining said plasma cavity, said film being made of a semiconductor including a silicon compound and in electrical contact with both said first and second electrodes.

* * * * *

UNITED STATES PATENT AND TRADEMARK OFFICE

CERTIFICATE OF CORRECTION

PATENT NO. : 4,337,408

DATED : June 29, 1982

INVENTOR(S) : Masazumi Sone et al

It is certified that error appears in the above—identified patent and that said Letters Patent is hereby corrected as shown below:

On the title page:

The address of the assignee, Nissan Motor Company, Limited should be:

Yokohama City, Japan

Signed and Sealed this

*Twenty-third* Day of *August 1983*

[SEAL]

*Attest:*

GERALD J. MOSSINGHOFF

*Attesting Officer*

*Commissioner of Patents and Trademarks*